US011607089B1

(12) United States Patent
Dove

(10) Patent No.: US 11,607,089 B1
(45) Date of Patent: Mar. 21, 2023

(54) INTERACTIVE SMART TOILET TRAINING DEVICE

(71) Applicant: Alisha Dove, Virginia Beach, VA (US)

(72) Inventor: Alisha Dove, Virginia Beach, VA (US)

( * ) Notice: Subject to any disclaimer, the term of this patent is extended or adjusted under 35 U.S.C. 154(b) by 0 days.

(21) Appl. No.: 17/487,180

(22) Filed: Sep. 28, 2021

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS 5,781,939 A * 7/1998 Bledsoe ..... A47K 11/04 4/479
6,038,711 A * 3/2000 Clarke ..... G09B 19/0076 4/449
7,237,278 B1 * 7/2007 Scott ..... A47K 13/24 4/483
9,715,836 B2 * 7/2017 Berkovich ..... A47K 13/06
2014/0259354 A1 * 9/2014 Sundberg ..... A47K 13/00 4/483
2018/0247564 A1 * 8/2018 Decker ..... A47K 11/06
2019/0021560 A1 * 1/2019 Del Duke ..... A47K 17/028

* cited by examiner

*Primary Examiner* — Huyen D Le
(74) *Attorney, Agent, or Firm* — Edward R. Ergenzinger

(57) ABSTRACT

An interactive smart toilet training device is provided in the form of a potty-training chair that resembles/mocks the traditional toilet in miniature form and has special/smart features to assist with potty training. The smart features enable the device to maintain the functionality of a standard toilet while attracting and engaging with the child and identifying, recording, and tracking metrics/history associated with the child's use of the device. Multiple interactive features include smart software applications, songs, and phrases to gain the toddler's attention, and a transparent lighted seat that lights on command, when in use, and/or when there was a successful sit/use. Tracking metrics/history to identify the frequency and conditions of successful sits/uses enable a more timely, accurate, and efficient means for successful completion of toilet training.

13 Claims, 3 Drawing Sheets

INTERACTIVE SMART TOILET TRAINING DEVICE

FIELD OF THE INVENTION

The present invention relates generally to the field of toilet training devices.

BACKGROUND

A "potty" chair (also known as a "potty-training" chair or device) is a toilet training device for very young children. A potty-training chair is a proportionately small toilet or chair with an opening that is designed for the size of the child and to provide additional comfort and safety over a traditional toilet.

There are currently a variety of potty-training chair designed to facilitate the successful completion of potty-training. These devices are used to attract the attention of a toddler, maintain functionality of a toilet, and use a reward mechanism to encourage usage. Although the reward mechanism may work for some toddlers when there is a successful use, many children have difficulty developing a routine with a non-interactive device. For some children, the reward mechanism is just as ineffective, as to some toddlers it is nothing but a mere sound. For other children, the device is not as effective, if effective at all, due to the duration of time it takes, the device's inability to identify correlations between the device and its uses, and reward mechanisms that at times can be altered, missed, and even faulty.

To parents of multiple children, the limitations of current toilet training devices are well known. If a device does not work efficiently and effectively for the first child, parents will not devote the means to purchase and/or use the device again for their other child(ren). Furthermore, since multi-tasking and potty training do not normally go hand in hand, monitoring multiple children creates the opportunity for more frequent potty-training accidents and clean-ups. Even at times when there is a successful potty, sometimes either the parents are not notified by the toddler or the device may not sound. This can create a potty-training accident or spill that could have been prevented with a backup notification to signal that there was a successful use and that the potty needs to be cleaned.

Accordingly, there is a need for improved toilet training devices. The present invention addresses this need by providing an interactive smart toilet training device that resembles/mocks a traditional toilet but in miniature form, and that has special/smart features to assist with potty-training. The smart features enable the interactive smart toilet training device to: 1) learn the potty-training habits of a child by identifying, recording, and tracking metrics/history associated with the child's use of the device; and 2) attract and engage with the child while still maintaining the functionality of a standard toilet.

SUMMARY

To address the foregoing problems, in whole or in part, and/or other problems that may have been observed by persons skilled in the art, the present disclosure provides compositions and methods as described by way of example as set forth below.

An interactive smart toilet training device is provided in the form of a potty-training chair that resembles/mocks the traditional toilet in miniature form and has special/smart features to assist with potty training. The smart features enable the device to maintain the functionality of a standard toilet while attracting and engaging with the child and identifying, recording, and tracking metrics/history associated with the child's use of the device. Multiple interactive features include smart software applications, songs, and phrases to gain the toddler's attention, and a transparent lighted seat that lights on command, when in use, and/or when there was a successful sit/use. Tracking metrics/history to identify the frequency and conditions of successful sits/uses enable a more timely, accurate, and efficient means for successful completion of toilet training.

In a particular embodiment, an interactive smart toilet training device is provided, comprising a miniature size toilet that mimics a standard size toilet, wherein the miniature size toilet comprises:

a) a removable waste container comprising one or more sensors configured to detect metrics of use, wherein metrics of use comprise dates, times, and numbers of uses as well as missed sits, accidents, successful sits, and successful uses;

b) a removable interactive base comprising lights, a splash guard, and a smooth dipped groove to protect both male and female genitalia from being scratched by the removable interactive base, wherein the removable interactive base is configured to be removed from a bottom base that provides bottom support, and further wherein the removable interactive base comprises lights and is configured to fit a standard toilet seat, wherein the removable interactive base comprises adjustable grips configured to grip the standard toilet seat;

c) a computer readable medium comprising a software application configured to identify, record, and track metrics of use detected by the one or more sensors and generate a customized routine based on a child's natural potty habits;

d) a tracker configured to display selected metrics of use, wherein the software application is configured to instruct the tracker to display selected metrics of use;

e) a lever configured such that movement of the lever:

i) triggers the software application to indicate that the interactive smart toilet training device has been flushed and provide a notification that the removable waste container is ready to be cleaned;

ii) triggers a children's lighted animated picture disposed in or on the interactive smart toilet training device to light up and produce a toilet flushing sound;

iii) triggers a music box disposed in or on the interactive smart toilet training device to play music, sounds, and/or phrases; and iv) triggers the lights of the removable interactive base to light up and change colors and patterns in sync with the music, sounds, and/or phrases; and f) a wireless communications interface configured to enable sharing of the metrics of use across the wireless network and to enable a parent or guardian to interface with the software application by means of a smart communication device;

wherein the software application is configured to track, monitor, and facilitate successful uses, comprising developing a routine metric to activate an autopilot mode wherein the software application triggers the music box and the lights of the removable interactive base to provide positive reinforcement to the child while also providing a notification that it is time for cleaning.

In some aspects, the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

In some aspects, the smart communication device and the interactive smart toilet training device are connected wirelessly, particularly using Bluetooth® or wireless fidelity (Wi-Fi).

In some aspects, the autopilot mode comprises a sleep autopilot mode wherein the software application switches to delayed use and provides a signal when it is time to wake the child up to use the interactive smart toilet training device, and further wherein the music box produces softer than normal music, sounds, and/or phrases and the lights of the removable interactive base are dimmer than normal.

In some aspects, the software application is further configured to provide a push-on-the-go mode, wherein the software application triggers the music box and the lights of the removable interactive base to sound and light up to attract the child's attention and signal that it is time to use the potty.

In some aspects, the music box is configured to sync with a smart communication device, wherein the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

In some aspects, the software application is configured such that the notification that the removable waste container is ready to be cleaned cannot be turned off until the removable waste container has been removed for cleaning.

In some aspects, the software application is configured such that the software application is further configured to enable manual entry of metrics of use by means of the smart communication device.

In some aspects, the adjustable grips are configured to be adjusted by a geared wheel, wherein the geared wheel is configured such that spinning the geared wheel in one direction tightens the adjustable grips, while spinning the geared wheel in the opposite direction loosens the adjustable grips.

In some aspects, the interactive smart toilet training device further comprises an on/off control.

In some aspects, the software application is configured to turn off the children's lighted animated picture, the music box, and/or the lights of the removable interactive base to accommodate children with hypersensitivities and/or disabilities.

A method of toilet training a child is also provided, comprising using the interactive smart toilet training device described above to provide positive reinforcement to the child and generate a customized routine based on the child's natural potty habits.

Additional features of the invention will be or will become apparent to one with skill in the art upon examination of the following figures and detailed description. It is intended that all such additional features and advantages be included within this description, be within the scope of the invention, and be protected by the accompanying claims.

BRIEF DESCRIPTION OF THE DRAWINGS

Figure 1:
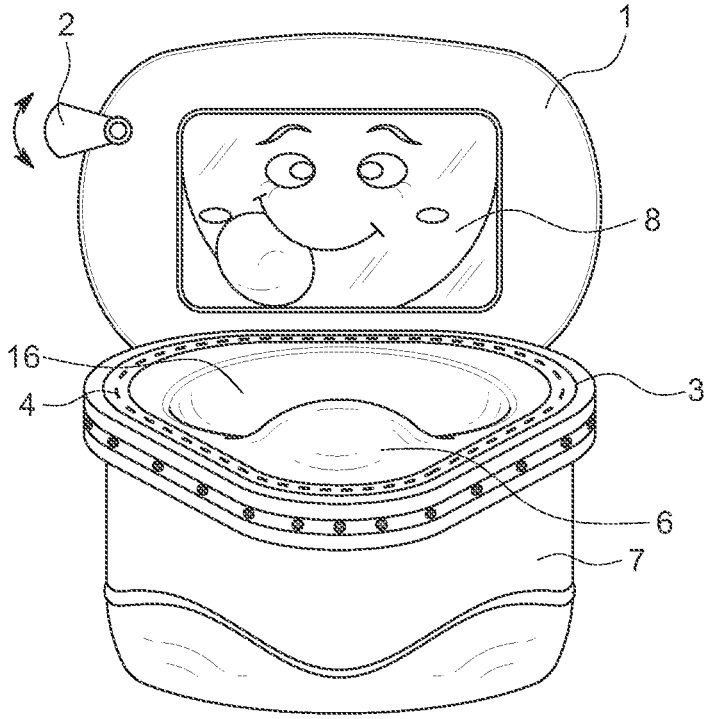
Figure 2:
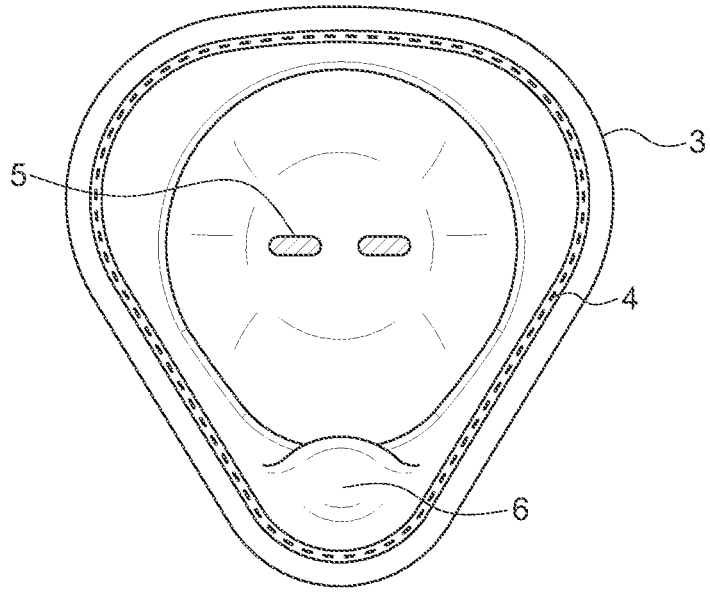
Figure 3:
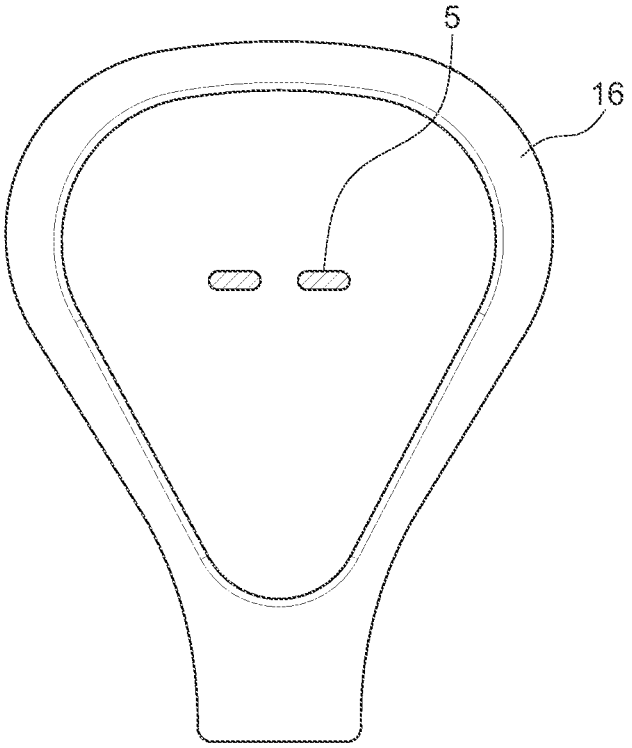
Figure 4:
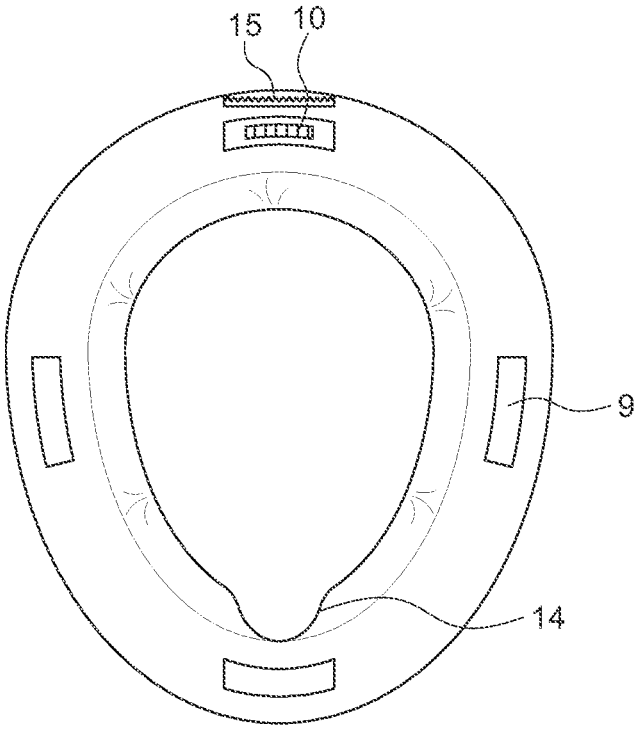
Figure 5:
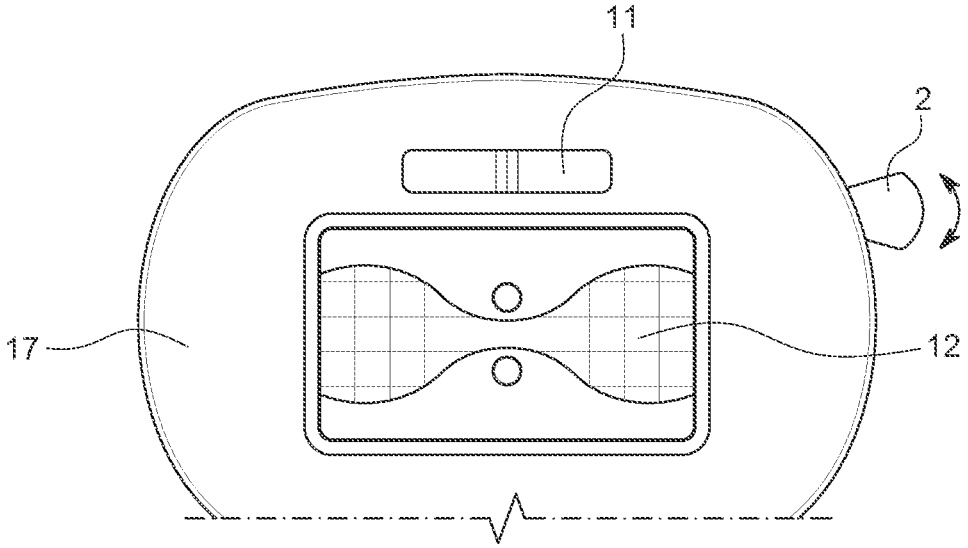
Figure 6:
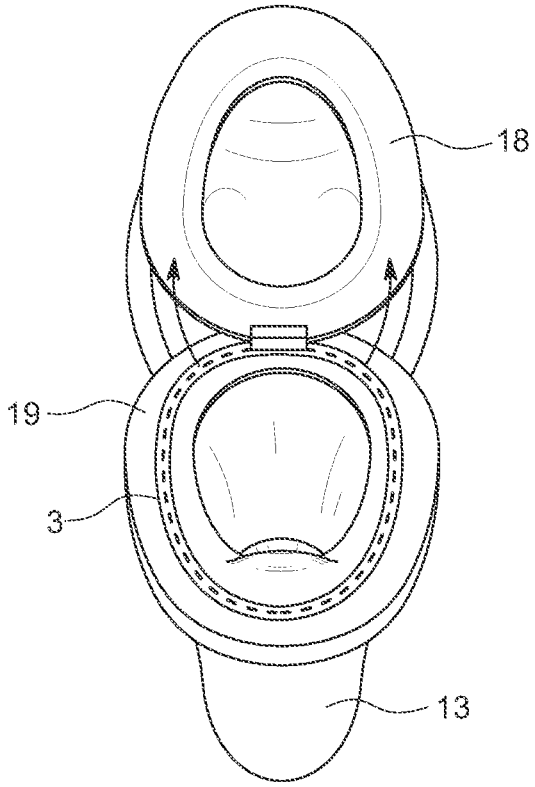

Having thus described the subject matter of the present invention in general terms, reference will now be made to the accompanying drawings, which are not necessarily drawn to scale, and wherein:

FIG. 1 is a front view of the interactive smart toilet training device in accordance with an embodiment of the invention;

FIG. 2 is a top view of sensors inside a removable waste bowl within the interactive smart toilet training device in accordance with an embodiment of the invention;

FIG. 3 is a top view of a removable interactive base including sensors within an interactive smart toilet training device in accordance with an embodiment of the invention;

FIG. 4 is a bottom view of a toilet seat within the interactive smart toilet training device in accordance with an embodiment of the invention;

FIG. 5 is a back view of the upper portion of the interactive smart toilet training device in accordance with an embodiment of the invention; and FIG. 6 is a perspective view of the removable seat of the interactive smart toilet training device in accordance with an embodiment of the invention attached to a full-sized toilet unit.

DETAILED DESCRIPTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. All illustrations of the drawings are for the purpose of describing selected versions of the present invention and are not intended to limit the scope of the present invention. Therefore, it is to be understood that the subject matter of the present invention is not to be limited to the specific embodiments disclosed and that modifications and other embodiments are intended to be included within the scope of the appended claims.

Interactive Smart Toilet Training Device

The present invention provides an interactive smart toilet training device to create an effective tool for efficient, prompt, and successful potty training. The interactive smart toilet training device of the present invention uses advanced technology to learn and create a routine, to attract, and to engage a child in the functionality of a toilet. Most importantly, the interactive smart toilet training device speeds up the process for successfully potty-training a toddler. The interactive smart toilet training device tracks, monitors, and facilitates potty uses once a routine is built or set in place. The interactive smart toilet training device monitors all interaction with the potty, including successful uses or sits and even records flushes. Such monitoring enables the interactive smart toilet training device to develop a routine metric to begin an autopilot mode. Once the autopilot mode is activated and it is time for use, a software application will send a signal to the device for sounding and lighting up the toilet seat while also sending a notification the parents. Missed sits, accidents, successful sits, and successful uses are all tracked by the software application.

Autopilot mode is used as a training/assistant feature to assist parents with the time frame it will take to successfully train the child. Autopilot mode gives parents the peace of mind that the child's potty-training habits are being monitored not only by the device, but also by the parent through the software application. This monitoring produces fewer accidents and a higher rate of successful uses while building data to correlate with the functionality of the potty. A parent can send a signal on the go so that if they feel that it is time for the child to use the potty before a given metric has been reached, the parent can send a signal for the potty to begin interacting with the child via sounds and lights to gain the toddler's attention. Since time is of the essence, the autopilot mode is used as an assistant for training to make sure that the routine is not broken and to produce a quicker more efficient means for successful potty training.

Another feature of the present invention is a transparent lighted toilet seat. The transparent lighted toilet seat is used to interact and engage the toddler to use the interactive smart toilet training device. The controls for the transparent lighted toilet seat are managed through the software application, which sends a signal to the device to light the toilet seat as well as to change the pattern, color, and/or syncing of the lights to the sound that the interactive smart toilet training device plays. This bright light in the transparent seat gains the attention of any toddler/child as well as the parent(s). The transparent toilet seat is adjustable for customized fit. The toilet seat is also removable and retains functionality while on a standard toilet (i.e., the toilet seat will still track and interact with the child). For those children with certain disorders like epilepsy, the transparent lighted toilet seat feature can be turned off, slowed down, and even dimmed.

The interactive smart toilet training device also has a feature wherein it resembles a standard toilet while maintaining its functionality. The interactive smart toilet training device has a lever that when flushed will sound the toilet and send a signal that it is now time to be cleaned, along with producing a musical and lighted reward feature to provide positive reinforcement to the child. The lever sends a separate notification to the software application that the potty has been used and flushed, and that a cleaning of the potty is needed. This notification must be disabled/disarmed or there will be a constant reminder that the potty is still soiled. This additional feature for the lever helps retain the functionality of a standard toilet as well as produce fewer accidental spills and reduce contamination and/or smells.

The sounds and phases of the interactive smart toilet training device are used in many different aspects. The sound and phrases are used to engage a child, gain their attention, and send them praise upon a successful sit/use. Phases that encourage a child to flush, wipe, wash hands, and sit on the potty are included, as well as a phase for congratulations. There are various sounds to encourage a successful potty such as water running and rain. Sound and songs play to gain a child's attention and to praise the child upon a successful sit/use. The parents may also send a signal to the potty to interact with the child by playing sounds, music, and/or lights.

The present invention also includes a sleep autopilot mode to assist both the toddler and the parent with potty training during sleep times. Once a parent activates sleep mode, the software application switches to delayed use, meaning that the software application understands that the toddler is not drinking, active, nor needing to use the potty as often. During the sleep mode, the interactive smart toilet training device uses softer tones and music to wake the toddler and alert them that it is time to wake up and potty. The device also sends a signal to the software application (e.g., on the parents' phone) letting the parents know as well that it is time to wake up and put child on the potty. Once the child has a successful use or sit, the device plays soft melodies so assist the toddler in going back to sleep. The sleep mode assists the parent with their child's potty use throughout the night, thereby preventing fewer accidents while maintaining the routine.

In a particular embodiment, an interactive smart toilet training device is provided, comprising a miniature size toilet that mimics a standard size toilet, wherein the miniature size toilet comprises:

a) a removable waste container comprising one or more sensors configured to detect metrics of use, wherein metrics of use comprise dates, times, and numbers of uses as well as missed sits, accidents, successful sits, and successful uses;

b) a removable interactive base comprising lights, a splash guard, and a smooth dipped groove to protect both male and female genitalia from being scratched by the removable interactive base, wherein the removable interactive base is configured to be removed from a bottom base that provides bottom support, and further wherein the removable interactive base comprises lights and is configured to fit a standard toilet seat, wherein the removable interactive base comprises adjustable grips configured to grip the standard toilet seat;

c) a computer readable medium comprising a software application configured to identify, record, and track metrics of use detected by the one or more sensors and generate a customized routine based on a child's natural potty habits;

d) a tracker configured to display selected metrics of use, wherein the software application is configured to instruct the tracker to display selected metrics of use;

e) a lever configured such that movement of the lever:

i) triggers the software application to indicate that the interactive smart toilet training device has been flushed and provide a notification that the removable waste container is ready to be cleaned;

ii) triggers a children's lighted animated picture disposed in or on the interactive smart toilet training device to light up and produce a toilet flushing sound;

iii) triggers a music box disposed in or on the interactive smart toilet training device to play music, sounds, and/or phrases; and iv) triggers the lights of the removable interactive base to light up and change colors and patterns in sync with the music, sounds, and/or phrases; and f) a wireless communications interface configured to enable sharing of the metrics of use across the wireless network and to enable a parent or guardian to interface with the software application by means of a smart communication device;

wherein the software application is configured to track, monitor, and facilitate successful uses, comprising developing a routine metric to activate an autopilot mode wherein the software application triggers the music box and the lights of the removable interactive base to provide positive reinforcement to the child while also providing a notification that it is time for cleaning.

In some aspects, the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

In some aspects, the smart communication device and the interactive smart toilet training device are connected wirelessly, particularly using Bluetooth® or wireless fidelity (Wi-Fi).

In some aspects, the autopilot mode comprises a sleep autopilot mode wherein the software application switches to delayed use and provides a signal when it is time to wake the child up to use the interactive smart toilet training device, and further wherein the music box produces softer than normal music, sounds, and/or phrases and the lights of the removable interactive base are dimmer than normal.

In some aspects, the software application is further configured to provide a push-on-the-go mode, wherein the software application triggers the music box and the lights of the removable interactive base to sound and light up to attract the child's attention and signal that it is time to use the potty.

In some aspects, the music box is configured to sync with a smart communication device, wherein the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

In some aspects, the software application is configured such that the notification that the removable waste container is ready to be cleaned cannot be turned off until the removable waste container has been removed for cleaning.

In some aspects, the software application is configured such that the software application is further configured to enable manual entry of metrics of use by means of the smart communication device.

In some aspects, the adjustable grips are configured to be adjusted by a geared wheel, wherein the geared wheel is configured such that spinning the geared wheel in one direction tightens the adjustable grips, while spinning the geared wheel in the opposite direction loosens the adjustable grips.

In some aspects, the interactive smart toilet training device further comprises an on/off control.

In some aspects, the software application is configured to turn off the children's lighted animated picture, the music box, and/or the lights of the removable interactive base to accommodate children with hypersensitivities and/or disabilities.

Referring now to FIG. 1, a front view is provided of interactive smart toilet training device 1 that mocks/resembles the features of a standard toilet (not shown). Interactive smart toilet training device 1 comprises a lever 2, a children's lighted animated picture 8, a removable interactive base 3, lights 4, a splash prevention guard 6, a bottom base 7 that provides bottom support, and a removable waste container 16 that contains waste sensors (not shown). Lever 2 sends a signal to a software application with a notification that interactive smart toilet training device 1 has been flushed and it is now time to empty/clean removable waste container 16.

Lever 2 also controls children's lighted animated picture 8, which lights once lever 2 is levered downward and also mocks the flushing sound and functionality of a standard toilet. Once lever 2 has activated, children's lighted animated picture 8 will begin to light and both lever 2 and children's lighted animated picture 8 control the sound of flushing.

Lever 2 also controls lights 4. Lights 4 are molded inside removable interactive base 3 and are controlled by a computer software application to change colors, patterns, and sync to sounds played by a music box (not shown). Lights 4 can also be dimmed, slowed, and/or turned off.

Referring now to FIG. 2, a top view is provided of a removable interactive base 3 within the interactive smart toilet training device of FIG. 1. Removable interactive base 3 is configured to be removed to fit a standard size toilet to continue advanced training to an adult sized toilet while still maintaining the interactive functionality of the child sized device. Sensor 5 is used to detect interaction with the interactive smart toilet training device (not shown). Sensor 5 also enables identification, recording, and tracking of metrics/history of successful uses. Protective splash guard 6 prevents splashes of waste.

Referring now to FIG. 3, a top view is provided of sensor 5 inside removable waste container 16. As described above, sensor 5 is used to detect interaction with the interactive smart toilet training device (not shown), and enables identification, recording, and tracking of metrics/history of successful uses. Upon a successful use, removable waste container 16 can be removed from the interactive smart toilet training device to be emptied out and cleaned. Sensor 5 sends a notification to the software application for notification of a successful use while sending a signal to the lights (not shown) and music box (not shown) to begin the reward mechanism by lighting in colorful bright lights, and vibrant patters, while the music box plays music, sounds, and/or phrases preselected through the software application.

Referring now to FIG. 4, a bottom view is provided of removable interactive base 3. Adjustable clamps/grips 9 are configured to grip a standard size toilet. Adjustable clamps/grips 9 may be loosened and/or tightened to custom fit a standard size toilet. Adjustable clamps/grips 9 are adjusted by geared wheel 15, which is configured such that spinning the geared wheel in one direction tightens adjustable clamps/grips 9, while spinning the geared wheel in the opposite direction loosens adjustable clamps/grips 9. Geared wheel 15 provides a protective measure so that removable interactive base 3 is secured to a standard size toilet in order to prevent falls, slips, and accidents. Tracker 10 displays the uses/sits/interactions with the interactive smart toilet training device (not shown). Smooth dipped groove 14 is positioned inside removable interactive base 3 to protect both male and female genitalia from being scratched from the liner of the base of the seat.

Referring now to FIG. 5, a back view is provided of the upper portion of the interactive smart toilet training device of FIG. 1, showing upper back portion 17. Upper back portion 17 comprises on/off control 11, lever 2, and music box 12. As described above, music box 12 sounds with pre-selected music, sounds, and/or phrases and is the sound control for interactive smart toilet training device 1. Music box 12 is triggered when sensor 5 detects a successful use and it is time to interact/gain the child's attention. Music box 12 is signaled by the software application to sound with pre-selected music, sounds, and/or phrases, alone or in coordination with the lighting of the lights and/or children's lighted animated picture. When lever 2 is levered downward, it also triggers tracker (not shown) to display the uses/sits/interactions with the interactive smart toilet training device. The software application Referring now to FIG. 6, a perspective view is provided of removable interactive base 3 of the interactive smart toilet training device of FIG. 1. Toilet seat lid 18 is in a raised position to show removable interactive base 3 secured in seat 19 of standard size toilet 13. Removable interactive base 3 is configured to custom fit standard size toilet 13.

In another embodiment, a method of toilet training a child is also provided, comprising using the interactive smart toilet training device described herein to provide positive reinforcement to the child and generate a customized routine based on the child's natural potty habits. In one embodiment, the method includes use of the interactive smart toilet training device described herein to track, monitor, and facilitate potty uses, including successful uses or sits and flushes, and to develop a routine metric to begin an autopilot mode. Once the autopilot mode is activated and it is time for use, a software application sends a signal to the device for sounding and lighting up the toilet seat to provide positive reinforcement to the child while also sending a notification to the parents that it is time for cleaning. Missed sits, accidents, successful sits, and successful uses are all tracked by the software application.

A method is also provided wherein the autopilot mode includes a sleep autopilot mode to assist both the toddler and the parent with potty training during sleep times. In this method, once a parent activates sleep mode, the software application switches to delayed use, meaning that the software application understands that the toddler is not drinking, active, nor needing to use the potty as often. As described elsewhere herein, during sleep mode, the interactive smart toilet training device uses softer tones and music to wake the toddler and alert them that it is time to wake up and potty. The device also sends a signal to the software application (e.g., on the parents' phone) letting the parents know that it is time to wake up and put child on the potty. Following a successful use or sit, the device plays soft melodies so assist the toddler in going back to sleep. The sleep autopilot mode assists the parent with their child's potty use throughout the night, thereby preventing fewer accidents while maintaining the routine.

It will be appreciated that various aspects of the invention may be embodied as a method, system, computer readable medium, and/or computer program product. Aspects of the invention may take the form of hardware embodiments, software embodiments (including firmware, resident software, micro-code, etc.), or embodiments combining software and hardware aspects that may all generally be referred to herein as a "circuit," "module," or "system." Furthermore, the methods of the invention may take the form of a computer program product on a computer-usable storage medium having computer-usable program code embodied in the medium.

Any suitable computer useable medium may be utilized for software aspects of the invention. The computer-usable or computer-readable medium may be, for example but not limited to, an electronic, magnetic, optical, electromagnetic, infrared, or semiconductor system, apparatus, device, or propagation medium. The computer readable medium may include transitory and/or non-transitory embodiments. More specific embodiments (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Program code for carrying out operations of the invention may be written in an object-oriented programming language such as Java, Smalltalk, C++ or the like. However, the program code for carrying out operations of the invention may also be written in conventional procedural programming languages, such as the "C" programming language or similar programming languages. The program code may be executed by a processor, application specific integrated circuit (ASIC), or other component that executes the program code. The program code may be simply referred to as a software application that is stored in memory (such as the computer readable medium discussed above). The program code may cause the processor (or any processor-controlled device) to produce a graphical user interface ("GUI"). The graphical user interface may be visually produced on a display device, yet the graphical user interface may also have audible features. The program code, however, may operate in any processor-controlled device, such as a computer, server, personal digital assistant, phone, television, or any processor-controlled device utilizing the processor and/or a digital signal processor.

The program code may locally and/or remotely execute. The program code, for example, may be entirely or partially stored in local memory of the processor-controlled device. The program code, however, may also be at least partially remotely stored, accessed, and downloaded to the processor-controlled device. A user's computer, for example, may entirely execute the program code or only partly execute the program code. The program code may be a stand-alone software package that is at least partly on the user's computer and/or partly executed on a remote computer or entirely on a remote computer or server. In the latter scenario, the remote computer may be connected to the user's computer through a communications network.

The invention may be applied regardless of networking environment. The communications network may be a cable network operating in the radio-frequency domain and/or the Internet Protocol (IP) domain. The communications network, however, may also include a distributed computing network, such as the Internet (sometimes alternatively known as the "World Wide Web"), an intranet, a local-area network (LAN), and/or a wide-area network (WAN). The communications network may include coaxial cables, copper wires, fiber optic lines, and/or hybrid-coaxial lines. The communications network includes wireless portions utilizing any portion of the electromagnetic spectrum and any signaling standard (such as the IEEE 802 family of standards, GSM/CDMA/TDMA or any cellular standard, and/or the ISM band). The communications network may even include powerline portions, in which signals are communicated via electrical wiring. The invention may be applied to any wireless/wireline communications network, regardless of physical componentry, physical configuration, or communications standard(s).

In some aspects, wireless communication interfaces may include, but are not limited to, an Intranet connection, Internet, Personal Area Networks (PANs) for the exchange of data over short distances, e.g., using short-wavelength radio transmissions in the industrial, scientific, and medical (ISM) band ISM band from 2400-2480 MHz) from fixed and mobile devices (e.g., Bluetooth® technology), wireless fidelity (Wi-Fi), Wi-Max, IEEE 802.11 technology, radio frequency (RF), Infrared Data Association (IrDA) compatible protocols, Local Area Networks (LANs), Wide Area Networks (WANs), Shared Wireless Access Protocol (SWAP), Zigbee, Near-Field Communication (NFC), LiFi, 5G, any combinations thereof, and other types of wireless networking protocols.

Certain aspects of invention are described with reference to various methods and method steps. It will be understood that each method step can be implemented by the program code and/or by machine instructions. The program code and/or the machine instructions may create means for implementing the functions/acts specified in the methods.

The program code may also be stored in a computer-readable memory that can direct the processor, computer, or other programmable data processing apparatus to function in a particular manner, such that the program code stored in the computer-readable memory produce or transform an article of manufacture including instruction means which implement various aspects of the method steps.

The program code may also be loaded onto a computer or other programmable data processing apparatus to cause a series of operational steps to be performed to produce a processor/computer implemented process such that the program code provides steps for implementing various functions/acts specified in the methods of the invention.

Definitions

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount, or range. Accordingly, unless indicated to the contrary, the numerical parameters set forth in the following specification and attached claims are not and need not be exact but may be approximate and/or larger or smaller as desired, reflecting tolerances, conversion factors, rounding off, measurement error and the like, and other factors known to those of skill in the art depending on the desired properties sought to be obtained by the subject matter of the present invention. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An interactive smart toilet training device comprising a miniature size toilet that mimics a standard size toilet, wherein the miniature size toilet comprises:

a) a removable waste container comprising one or more sensors configured to detect metrics of use, wherein metrics of use comprise dates, times, and numbers of uses as well as missed sits, accidents, successful sits, and successful uses;

b) a removable interactive base comprising lights, a splash guard, and a smooth dipped groove to protect both male and female genitalia from being scratched by the removable interactive base, wherein the removable interactive base is configured to be removed from a bottom base that provides bottom support, and further wherein the removable interactive base comprises lights and is configured to fit a standard toilet seat, wherein the removable interactive base comprises adjustable grips configured to grip the standard toilet seat;

c) a computer readable medium comprising a software application configured to identify, record, and track metrics of use detected by the one or more sensors and generate a customized routine based on a child's natural potty habits;

d) a tracker configured to display selected metrics of use, wherein the software application is configured to instruct the tracker to display selected metrics of use;

e) a lever configured such that movement of the lever:

i) triggers the software application to indicate that the interactive smart toilet training device has been flushed and provide a notification that the removable waste container is ready to be cleaned;

ii) triggers a children's lighted animated picture disposed in or on the interactive smart toilet training device to light up and produce a toilet flushing sound;

iii) triggers a music box disposed in or on the interactive smart toilet training device to play music, sounds, and/or phrases; and iv) triggers the lights of the removable interactive base to light up and change colors and patterns in sync with the music, sounds, and/or phrases; and f) a wireless communications interface configured to enable sharing of the metrics of use across the wireless network and to enable a parent or guardian to interface with the software application by means of a smart communication device;

wherein the software application is configured to track, monitor, and facilitate successful uses, comprising developing a routine metric to activate an autopilot mode wherein the software application triggers the music box and the lights of the removable interactive base to provide positive reinforcement to the child while also providing a notification that it is time for cleaning.

2. The interactive smart toilet training device of claim 1, wherein the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

3. The interactive smart toilet training device of claim 1, wherein the smart communication device and the interactive smart toilet training device are connected wirelessly.

4. The interactive smart toilet training device of claim 3, wherein the smart communication device and the interactive smart toilet training device are connected wirelessly using Bluetooth® or wireless fidelity (Wi-Fi).

5. The interactive smart toilet training device of claim 1, wherein the autopilot mode comprises a sleep autopilot mode wherein the software application switches to delayed use and provides a signal when it is time to wake the child up to use the interactive smart toilet training device, and further wherein the music box produces softer than normal music, sounds, and/or phrases and the lights of the removable interactive base are dimmer than normal.

6. The interactive smart toilet training device of claim 5, wherein the software application is further configured to provide a push-on-the-go mode, wherein the software application triggers the music box and the lights of the removable interactive base to sound and light up to attract the child's attention and signal that it is time to use the potty.

7. The interactive smart toilet training device of claim 1, wherein the music box is configured to sync with a smart communication device, wherein the smart communication device is a smartphone or smart watch that uses an operating system (OS) comprising Apple iOS, Android OS, Android Wear OS, Android Open-Source Project OS, Tizen OS, MS window OS, BlackBerry OS, FireFox OS, or MiUi Color OS.

8. The interactive smart toilet training device of claim 1, wherein the software application is configured such that the notification that the removable waste container is ready to be cleaned cannot be turned off until the removable waste container has been removed for cleaning.

9. The interactive smart toilet training device of claim 1, wherein the software application is configured such that the software application is further configured to enable manual entry of metrics of use by means of the smart communication device.

10. The interactive smart toilet training device of claim 1, wherein the adjustable grips are configured to be adjusted by a geared wheel, wherein the geared wheel is configured such that spinning the geared wheel in one direction tightens the adjustable grips, while spinning the geared wheel in the opposite direction loosens the adjustable grips.

11. The interactive smart toilet training device of claim 1, further comprising an on/off control.

12. The interactive smart toilet training device of claim 1, wherein the software application is configured to turn off the children's lighted animated picture, the music box, and/or the lights of the removable interactive base to accommodate children with hypersensitivities and/or disabilities.

13. A method of toilet training a child, comprising using the interactive smart toilet training device of claim 1 to provide positive reinforcement to the child and generate a customized routine based on the child's natural potty habits.

* * * * *